US008568078B2

(12) United States Patent
Ornig et al.

(10) Patent No.: US 8,568,078 B2
(45) Date of Patent: Oct. 29, 2013

(54) RAILWAY CAR DOOR OPERATOR ASSEMBLY

(75) Inventors: Joseph R. Ornig, Waukegan, IL (US); Michael L. Schirmer, St. Louis, MO (US)

(73) Assignee: Aldon Company, Inc., Waukegan, IL (US)

( * ) Notice: Subject to any disclaimer, the term of this patent is extended or adjusted under 35 U.S.C. 154(b) by 1107 days.

(21) Appl. No.: 12/157,572

(22) Filed: Jun. 12, 2008

(65) Prior Publication Data

US 2008/0276828 A1 Nov. 13, 2008

Related U.S. Application Data

(63) Continuation-in-part of application No. 11/148,997, filed on Jun. 10, 2005, now abandoned.

(51) Int. Cl.
*B66F 9/18* (2006.01)

(52) U.S. Cl.
USPC ..... 414/607; 414/664

(58) Field of Classification Search
USPC ..... 414/607, 664
See application file for complete search history.

(56) References Cited

U.S. PATENT DOCUMENTS

| | | | | | |
|---|---|---|---|---|---|
| 2,410,373 | A | * | 10/1946 | Westervelt, Jr. | 414/607 |
| 2,433,584 | A | | 12/1947 | Turner | |
| 2,941,683 | A | * | 6/1960 | Fowler | 414/607 |
| 3,007,592 | A | * | 11/1961 | Adams | 414/607 |
| 3,556,328 | A | | 1/1971 | Miles et al. | |
| 3,587,893 | A | | 6/1971 | Laken | |
| 3,788,492 | A | | 1/1974 | Kraft | |
| 3,850,322 | A | | 11/1974 | Miles et al. | |
| 4,149,644 | A | | 4/1979 | Fuller | |
| 4,160,509 | A | | 7/1979 | Switzer | |
| 4,290,730 | A | | 9/1981 | Weaver | |
| 4,579,504 | A | | 4/1986 | Lemme et al. | |
| 4,946,488 | A | | 8/1990 | Davison | |
| 5,560,129 | A | | 10/1996 | Rothbart | |
| 5,653,569 | A | | 8/1997 | Sears | |
| 5,850,704 | A | | 12/1998 | Harinen | |

* cited by examiner

*Primary Examiner* — Saul Rodriguez
*Assistant Examiner* — Willie Berry, Jr.
(74) *Attorney, Agent, or Firm* — Anthony S. Zummer

(57) ABSTRACT

A railway car door operator assembly is adapted for use in opening or closing railway car doors. The assembly is mountable on a self-propelled vehicle and includes a base mountable on the vehicle. An elongated arm having one end secured to an articulated joint on the base secures the arm to the base limiting movement of the arm to movement in a substantially horizontal plane. Another end of the arm is secured to a releasable restraint for releasable connection to a railway car door.

14 Claims, 4 Drawing Sheets

RAILWAY CAR DOOR OPERATOR ASSEMBLY

CROSS REFERENCE TO RELATED APPLICATION

The instant application is a continuation-in-part of patent application Ser. No. 11/148,997, filed Jun. 10, 2005, entitled, "Railway Car Door Operator Assembly" (now abandoned).

BACKGROUND OF THE INVENTION

This invention relates to an improved railway car door operator assembly which is mountable on a self-propelled vehicle for selectively opening and closing railway car doors.

A common problem with railway car doors is that a substantial amount of force is required either to open the door or to close the door. The utilization of a vehicle to open or to close a door is well recognized. Three prior art patents show devices attached to a forklift truck for opening or closing a railway car door. Those prior art patents are: U.S. Pat. No. 4,149,644, entitled, "Fork Lift Truck Attachment" issued Apr. 17, 1979, to Richard C. Fuller; U.S. Pat. No. 4,160,509, entitled, "Freight Car Door Opener" issued Jul. 10, 1979, to Ralph V. Switzer; and U.S. Pat. No. 4,290,730, entitled, "Attachment For Fork Lift" issued Sep. 22, 1981, to James A. Weaver. The devices shown in the three prior art patents are effective in a situation wherein the truck may move in a straight line the length of the distance required for opening or closing the door. However, there are situations wherein the truck is prohibited from moving in a straight line. For instance, if a loading dock is enclosed, that is, it is under a roof with walls and the walls have openings just large enough to align with the opening of a box car. In those instances, the known freight car door openers may not be used effectively due to the space limitations interiorally of the loading dock.

It is an object of the present invention to provide an improved railway car door operator assembly which is mountable on a self-propelled vehicle, such as, a forklift truck either to open or to close a freight car door in a minimum of space. Other objects and uses of the present invention will become readily apparent to those skilled in the art upon perusal of the following specification in light of the accompanying drawings.

BRIEF SUMMARY OF THE INVENTION

The present invention is an improved railway car door operator assembly for mounting on a self-propelled vehicle to open or to close selectively railway car doors. The vehicle is supported on and operable as a substantially horizontal support surface. The door operator assembly includes a base which is mountable on a self-propelled vehicle. An elongated operating arm having a pair of opposed arm ends has one of the arm ends movably connected to the base by an articulated joint. The articulated joint limits the arm to movement substantially parallel to the support surface. A releasable restraint is mounted on the other of the opposed arm ends. The restraint is releasably connectable to a railway car door for secure attachment of the operator assembly to the railway car door, so that movement of the vehicle moves the door.

DETAILED DESCRIPTION OF THE INVENTION

Figures 1, 2, 3, 4:
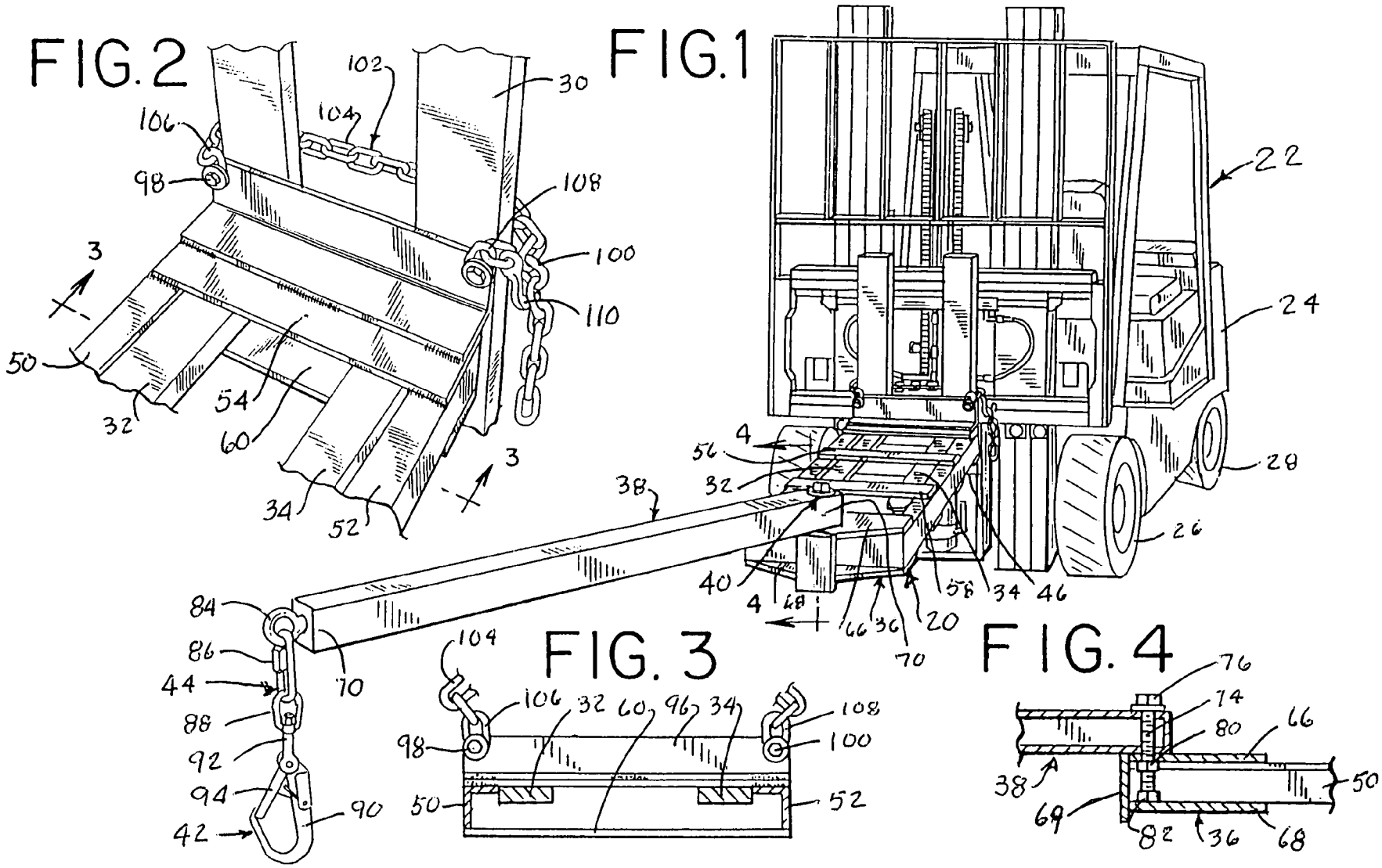
FIG. 1 is a perspective view of the railway car door operator assembly embodying the present invention shown mounted on a forklift truck.
FIG. 2 is a perspective view of a portion of the car door operator assembly releasably locked to a mast of the forklift truck.
FIG. 3 is a cross sectional view taken on Line 3-3 of FIG. 2.
FIG. 4 is a cross sectional view taken on Line 4-4 of FIG. 1.

Referring now to the drawings, and in particular FIG. 1, a railway car door operator assembly which is a specific embodiment of the instant invention is shown therein and is generally indicated by numeral 20. Operator assembly 20 is shown mounted on a self-propelled vehicle and in this case, a conventional and well known forklift truck generally indicated by the numeral 22. The truck is conventionally supported on a conventional horizontal support surface, that is, floor 23, as may be seen in FIG. 5.

Forklift truck 22 includes a conventional body 24 having a pair of front wheels 26 and a pair of turnable rear wheels 28. Wheels 26 and 28 operably engage floor 23, as is conventional. A mast 30 is mounted on the front portion of the body with a pair of forwardly extended conventional prongs 32 and 34 mounted on the mast. The prongs 32 and 34 shown herein are conventionally flat forwardly extending prongs and are shown solely for the purpose of illustration. It is to be understood that other types of devices for holding material may be used rather than the prongs shown herein. For instance, curved prongs may be used such as those which are often used in paper mills. The operation of forklift truck 22 is conventional and is well known.

Railway car door operator assembly 20 generally includes a base 36 connected to a longitudinal arm 38 through an articulated joint 40 movably connecting the longitudinal arm with the base. A restraint 42 is connected to one end of longitudinal arm 38 through a swivel 44, as may be seen in FIG. 1. The restraint 42 may be a hook, shackle, or other securing device which may be readily and releasably secured to a railway car door.

Base 36 has a mounting end 46 positioned adjacent to the forklift truck when operationally mounted on the truck. A forward end 48 of the base is opposed to the mounting end. The base includes a pair of spaced angle beams 50 and 52. Upper cross braces 54, 56 and 58 are welded to the upper portion of angle beams 50 and 52. Three lower cross braces 60, 62 and 64 are welded to the lower portion of beams 50 and 52 to define a prong receptacle adjacent to mounting end 46. A pair of support plates 66 and 68 is welded to the beams 50 and 52 at forward end 48. A head plate 69 is welded to support plates 66 and 68 at the forward end, as may be seen in FIG. 4.

Longitudinal arm 38 is a box construction having a hollow interior to provide a light weight to strength construction relative to a sold construction. Arm 38 has a pair of opposed arm ends 70 and 72 and has a longitudinal axis which extends between the two arm ends. Support arm end 70 is connected to the base by articulated joint 40. The opposite end of the longitudinal arm is connector end 72 which is connected to restraint 42. As may be best seen in FIG. 4, articulated joint 40 includes a threaded pivot pin 74 which has a head 76 formed integral therewith. A washer 78 is positioned between head 76 and longitudinal arm 38. An upper inner nut 80 is mounted on the pivot pin in engagement with plate 66. A lower inner nut 82 is mounted on the pivot pin in engagement with plate 66. The pivot pin is the axis for pivoting of arm 38 and is perpendicular to the longitudinal axis of arm 38 and to the base. Thus, articulated joint 40 allows the longitudinal arm 38 to pivot about the base on an axis of pivoting which is perpendicular to the longitudinal axis of the longitudinal arm and to the base, so that arm 38 is limited in movement relative to the base substantially parallel to floor 23.

Swivel 44 includes an eyebolt 84 mounted in connector end 72 of the longitudinal arm. A link 86 is mounted on the eyebolt. A shackle link 88 is also mounted on link 86. The restraint 42 includes a hook 90 which has a shackle rod 92 pivotedly connected at one end of the hook. The other end of rod 92 is pivotal in link 88. A dog 94 is pivotedly connected to the hook for securing the hook when the hook is positioned in place.

An angle iron mounting bracket 96 is welded to beams 50 and 52 at the mounting end of the base. The mounting bracket has a pair of lock studs 98 and 100 mounted therein. A lock 102 is connected to the base and engages mast 30 of the forklift truck to secure releasably the base to forklift truck 22. Lock 102 includes a chain 104 which has a link 106 secured to locking stud 98. The lock includes a link 108 secured to locking stud 100. A hook 110 is connected to link 108 and is engagable with a selected link of chain 104 so that the base may be secured to mast 30.

Figure 5:
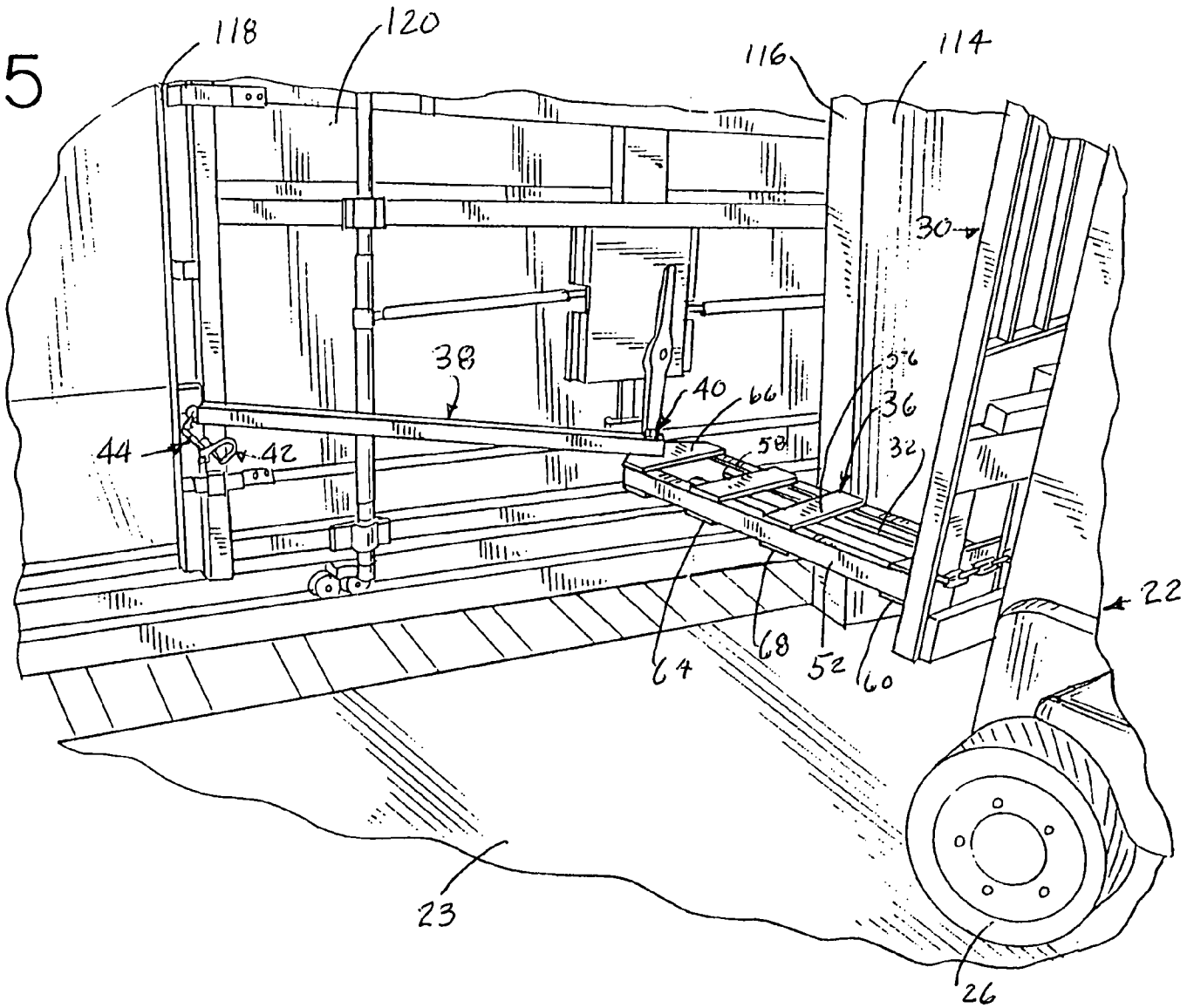
FIG. 5 is a perspective view of the railway car door operator assembly connected to a railway car door through an opening in an enclosed loading dock.

The utilization of the subject railway car door operator assembly is described below for the purpose of illustration of how the subject assembly may be used but the illustration is not intended to limit the use of the instant assembly. Referring now to FIG. 5, a portion of conventional enclosed loading dock is shown therein having a floor 23 with a wall 114 on the floor. The wall has an opening 116 therein. Opening 116 may be selectively closed by a door which is not shown herein. A railway car 118 is spotted adjacent to the dock with a door 120 of the car aligned with opening 116.

Railway car door operator 20 is mounted on forklift truck 22 by moving truck 22 forward to insert prongs 32 and 34 into base 36 and continue moving truck 22 toward the base until mounting end 46 abuts mast 30. Chain 104, which has links 106 fixed to mounting bracket 96, is wrapped around mast 30 of the forklift truck and hook 110 is secured in a link of chain 104 to secure the operator assembly to the forklift truck. The forklift truck with the operator assembly is moved to a position adjacent to a railway car door 120, which is to be opened. Restraint 42 is positioned in a conventional pocket of the door wherein hook 90 is positioned in the pocket and dog 94 locks the restraint to door 120.

Figure 6:
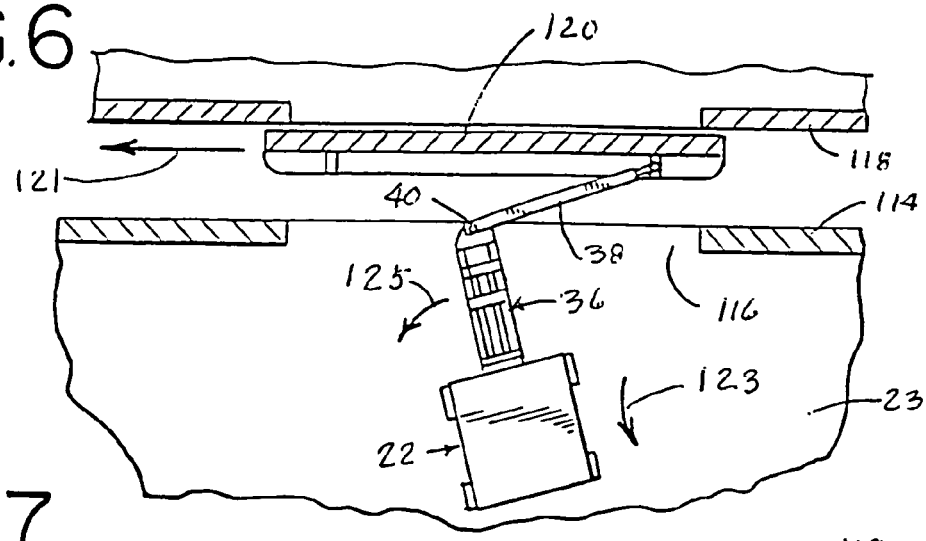
FIG. 6 is a schematic view showing an initial position of the railway car door operator assembly mounted on a forklift truck and connected to a railway car door through an opening in an enclosed loading dock.
Figure 7:
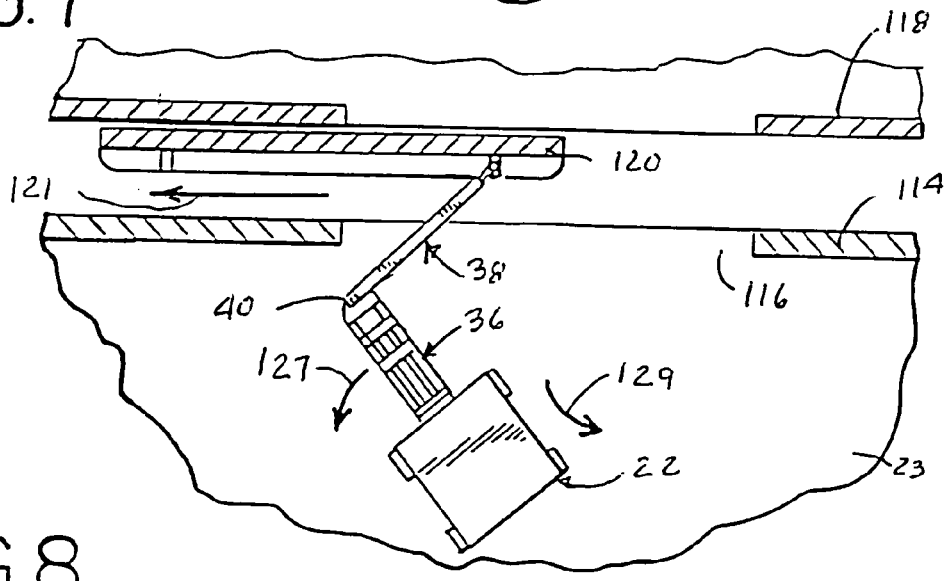
FIG. 7 is a schematic view like FIG. 6, but showing the position of the railway car door, the operator assembly and the forklift truck during the movement of the forklift truck in the initial step of opening the railway car door.
Figure 8:
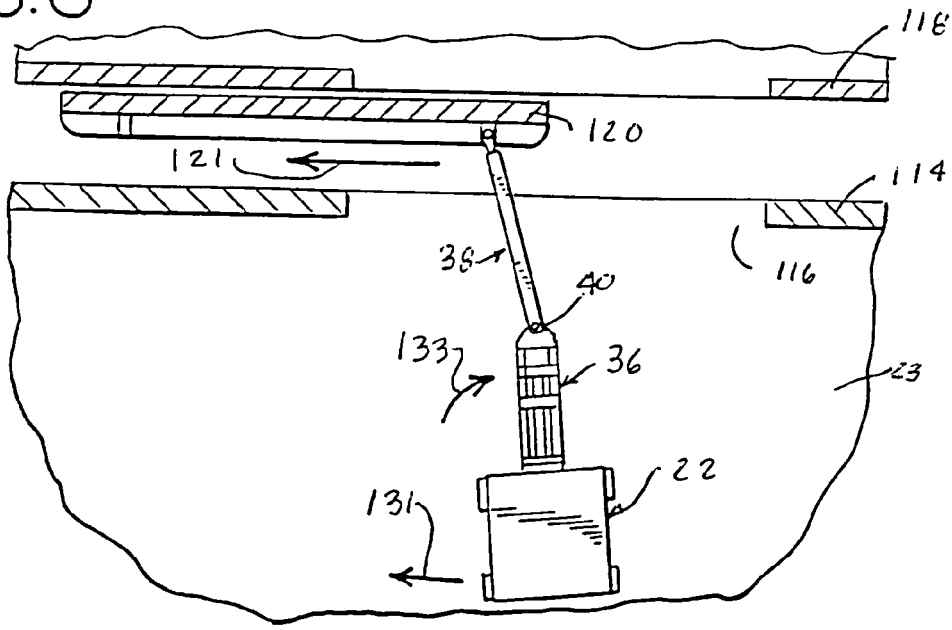
FIG. 8 is a schematic view similar to FIG. 6, but showing another position after the position shown in FIG. 7 in the steps of opening the railway car door.
Figure 9:
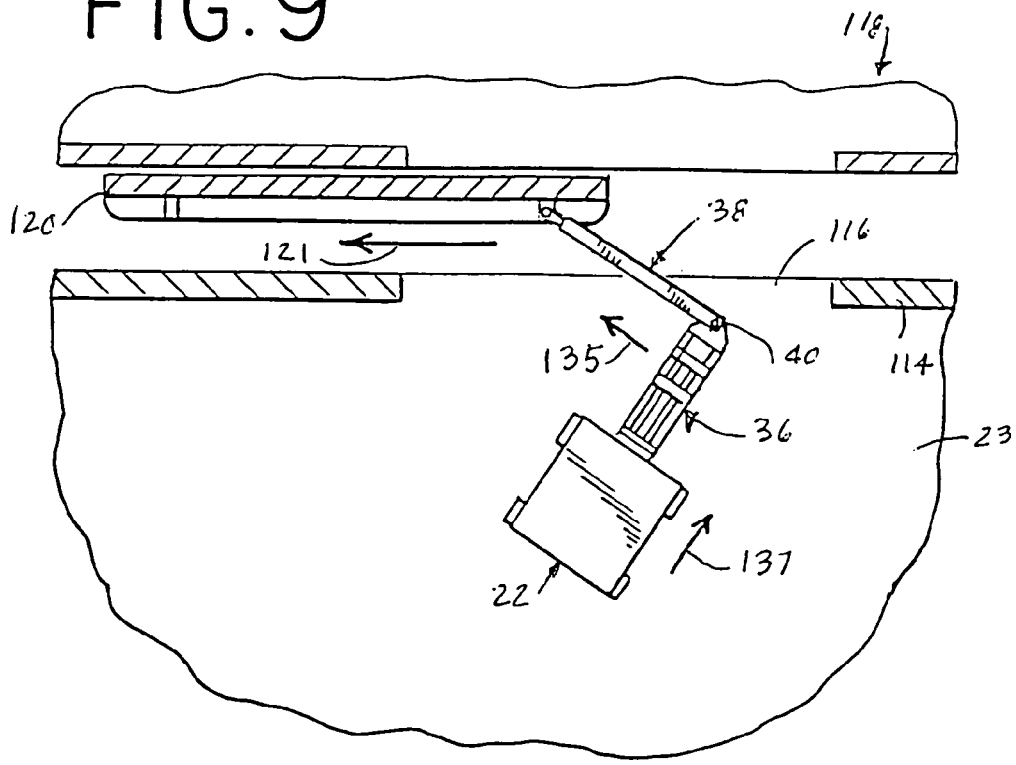
FIG. 9 is a schematic view similar to FIG. 6, but showing the position of the railway car door operator assembly and forklift truck in one step after that shown in FIG. 8.

Once the restraint is secured to door 120, forklift truck 22 is operated to pull open the door in the direction indicated by arrow 121. Several steps in moving the forklift truck with the operator assembly to open door 120 are shown in FIGS. 6-10. The initial position of the operator assembly and forklift truck relative to door 120 is shown in FIG. 6. Forklift truck 22 is then moved in the direction shown by arrow 123 to swing base 36 of the operator assembly in a counterclockwise direction as indicated by arrow 125 and swing the arm parallel to the floor. The forklift truck is moved away from the door. This movement applies a tensile force to the longitudinal arm to move door 120 initially. The continuous swinging of the base as shown by arrow 127 and movement of the forklift truck as shown by arrow 129 positions the forklift truck and arm to the attitude shown in FIG. 7 wherein the door is partially opened. The forklift truck is then moved further away from the door and pivoted as identified by arrow 131 and the base is swung in a clockwise position as identified by arrow 133 so that the position of the forklift truck with the operator assembly and door is that shown in FIG. 8. The base is pivoted in a counterclockwise position as identified by arrow 135 and the forklift truck is moved toward the railway car as shown by arrow 137 to the attitude shown in FIG. 9 to apply a compression force to the longitudinal arm. The arm is moved to the attitude shown in FIG. 10, so that the railway car door is completely opened.

Figure 10:
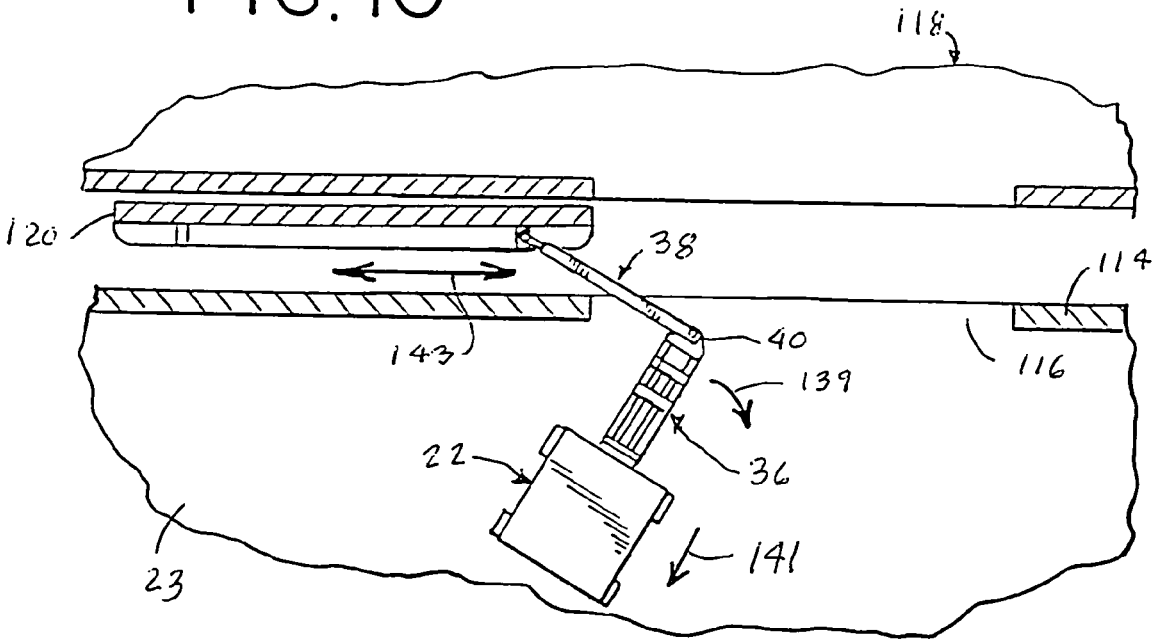
FIG. 10 is a schematic view similar to FIG. 6 showing the final position of the railway car door in a fully opened position and the position of the operator assembly and forklift truck when the door is fully opened.

The railway car door may be closed by attaching the restraint to the door with the forklift truck and operator assembly in the attitude shown in FIG. 10. Base 36 is pivoted in a clockwise direction as identified by arrow 139 and the forklift truck is moved in the direction shown by arrow 141 and door 120 is moved to close the opening in the box car indicated by double arrow 143 showing movement of the door in either direction. The steps used in opening the door are simply reversed in order to close the railway car door.

From the foregoing description in light of FIGS. 6-10, it may be seen how the forklift truck is kept in a confined area aligned with the opening in the loading dock. It is not necessary to move the forklift truck along the loading dock to open the door, but rather the forklift truck may be readily utilized to open and close the door in a relatively narrow space.

Although a specific construction of the herein disclosed invention has been described in detail, it is readily apparent that those skilled in the art may make various modifications and changes without departing from the spirit and scope of the present invention. It is expressly understood that the present invention is limited only by the appended claims.

What is claimed is:

1. A railway car door operator assembly adapted for mounting on a self-propelled vehicle having a forwardly extending prong and supported on a substantially horizontal surface for selectively opening or closing railway car doors comprising:

a base mountable on the self-propelled vehicle, an elongated operating arm having a first arm end and a second arm end, said first and second arm ends being opposed to each other, a restraint connected to the first arm end, said restraint being releasably connectable to a railway car door, an articulated joint secured to the second arm end and to the base to secure pivotally the arm to the base to limit the arm movement relative to the base to move substantially horizontally parallel to the support surface to apply selectively a compression or a tensile force to the operating arm for selectively moving the railway car door connected to the restraint.

2. A railway car door operator assembly adapted for mounting on a self-propelled vehicle having a forwardly extending prong and supported on a substantially horizontal surface for selectively opening or closing railway car doors as defined in claim 1, and said base includes a receptacle portion for receipt of the prong of the self-propelled vehicle.

3. A railway car door operator assembly adapted for mounting on a self-propelled vehicle having a forwardly extending prong and supported on a substantially horizontal surface for selectively opening or closing railway car doors as defined in claim 1, wherein said operator arm has a longitudinal axis between the first and second arm ends, the articulated joint is a pivot, said pivot having an axis of pivoting substantially perpendicular to the support surface, said pivot having an axis of pivoting substantially perpendicular to the longitudinal axis of the operating arm.

4. A railway car door operator assembly adapted for mounting on a self-propelled vehicle having a forwardly extending prong and supported on a substantially horizontal surface for selectively opening or closing railway car doors as defined in claim 1, including a swivel connecting the restraint to said second arm end to allow the restraint to move relative to the second arm end.

5. A railway car door operator assembly adapted for mounting on a self-propelled vehicle having a forwardly extending prong and supported on a substantially horizontal surface for selectively opening or closing railway car doors as defined in claim 1, including a releasable lock adapted for releasably securing the base to the vehicle.

6. A railway car door operator assembly adapted for mounting on a self-propelled vehicle having a forwardly extending prong and supported on a substantially horizontal surface for selectively opening or closing railway car doors as defined in claim 1, said base includes a receptacle portion for receipt of the prong, said operating arm having a longitudinal axis extending between the first and the second arm ends, said articulated joint is a pivot having an axis of pivoting substantial perpendicular to the longitudinal axis of the operating arm and to the support surface.

7. A railway car door operator assembly adapted for mounting on a self-propelled vehicle having a forwardly extending prong and supported on a substantially horizontal surface for selectively opening or closing railway car doors as defined in claim 1, including a swivel connecting the restraint to the operating arm to allow the restraint to move relative to the operating arm, and releasable lock adapted for releasably securing the base to the self-propelled vehicle.

8. A railway car door operator assembly adapted for mounting on a self-propelled vehicle having a forwardly extending prong and supported on a substantially horizontal surface for selectively opening or closing railway car doors as defined in claim 1, said base includes a receptacle portion for receipt of the prong, and a releasable lock connected to the base adapted for releasably securing the base to the vehicle.

9. A railway car door operator assembly adapted for mounting on a self-propelled vehicle having a forwardly extending prong and supported on a substantially horizontal surface for selectively opening or closing railway car doors as defined in claim 1, including a releasable lock connected to the base, said lock adapted for releasably securing the base to the self-propelled vehicle, said operating arm having a longitudinal axis extending between the first and the second arm ends, and said articulated joint is a pivot having an axis of pivoting substantially perpendicular to the longitudinal axis of the operating arm and to said substantially horizontal surface.

10. A railway car door operator assembly adapted for mounting on a self-propelled vehicle having a forwardly extending prong and supported on a substantially horizontal surface for selectively opening or closing railway car doors as defined in claim 1, said base having a pair of opposed base ends, said base having a receptacle portion at one of said base ends, said receptacle portion of said base adapted for receipt of the prong of the self-propelled vehicle, and a releasable lock connected to the base, said lock adapted for releasably securing the base to the self-propelled vehicle.

11. A railway car door operator assembly adapted for mounting on a self-propelled vehicle having a forwardly extending prong and supported on a substantially horizontal surface for selectively opening or closing railway car doors as defined in claim 1, wherein said operating arm has a longitudinal axis between the first and the second arm ends, said articulated joint is a pivot having an axis of pivoting substantially perpendicular to the longitudinal axis of the operating arm, a swivel connecting the restraint to the operating arm to allow the restraint to move relative to the operating arm, and a releasable lock adapted for releasably securing the base to the self-propelled vehicle.

12. A railway car door operator assembly adapted for mounting on a self-propelled vehicle having a forwardly extending prong and supported on a substantially horizontal surface for selectively opening or closing railway car doors as defined in claim 1, wherein said operating arm has a longitudinal axis between the first and the second arm ends, said articulated joint is a pivot having an axis of pivoting substantially perpendicular to the longitudinal axis of the operating arm, a releasable lock connected to the base, said lock adapted for releasably securing the base to the self-propelled vehicle, and a swivel connecting the restraint to the operating arm to allow the restraint to move relative to the operating arm.

13. A railway car door operator assembly adapted for mounting on a self-propelled vehicle having a forwardly extending prong and supported on a substantially horizontal surface for selectively opening or closing railway car doors as defined in claim 1, said base includes a receptacle portion for receipt of the prong, said operator arm having a longitudinal axis between the first and the second arm ends, and said articulated joint is a pivot having an axis of pivoting substantially perpendicular to the longitudinal axis of the operating arm.

14. A railway car door operator assembly adapted for mounting on a self-propelled vehicle having a forwardly extending prong and supported on a substantially horizontal surface for selectively opening or closing railway car doors as defined in claim 1, said base having a pair of opposed base ends, one of said base ends having a receptacle portion for receipt of the prong, said elongated operating arm has a longitudinal axis between the first and the second arm ends, said articulated joint is a pivot having an axis of pivoting substantially perpendicular to the longitudinal axis of the operating arm, a swivel connecting the restraint to the operating arm to allow the restraint to move relative to the operating arm, and a releasable lock connected to the base, said lock adapted for releasably securing the base to the self-propelled vehicle.

* * * * *